US010095155B2

(12) United States Patent
Hotogi et al.

(10) Patent No.: US 10,095,155 B2
(45) Date of Patent: Oct. 9, 2018

(54) METHOD OF TRANSFERRING INFORMATION INDICATING REFLECTING SURFACE OF ROTATING POLYGONAL MIRROR

(71) Applicant: CANON KABUSHIKI KAISHA, Tokyo (JP)

(72) Inventors: Tatsuya Hotogi, Susono (JP); Fumiaki Mizuno, Nagoya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/634,889

(22) Filed: Jun. 27, 2017

(65) Prior Publication Data

US 2018/0024461 A1 Jan. 25, 2018

(30) Foreign Application Priority Data

Jul. 25, 2016 (JP) ..... 2016-145696

(51) Int. Cl.
*G03G 15/04* (2006.01)
*G03G 15/043* (2006.01)

(52) U.S. Cl.
CPC ..... *G03G 15/043* (2013.01); *G03G 15/04036* (2013.01)

(58) Field of Classification Search
CPC ..... G03G 15/043; G03G 15/04036
See application file for complete search history.

(56) References Cited

U.S. PATENT DOCUMENTS 8,400,698 B2 3/2013 Fujii et al. ..... 359/199.1
9,291,937 B2 3/2016 Shirahata ..... G03G 15/043
2015/0241811 A1* 8/2015 Shirahata ..... G03G 15/043 399/51
2016/0363883 A1* 12/2016 Fukuhara ..... G03G 15/043
2017/0153568 A1* 6/2017 Shirakawa ..... G03G 15/043
2017/0285510 A1* 10/2017 Furuta ..... G03G 15/043

FOREIGN PATENT DOCUMENTS

JP H04-247760 9/1992
JP 2000-301766 10/2000
JP 2006-142716 6/2006
JP 2014-038165 2/2014
JP 2015-158526 9/2015

OTHER PUBLICATIONS

U.S. Appl. No. 15/491,648, filed Apr. 19, 2017.
U.S. Appl. No. 15/666,226, filed Aug. 1, 2017.
Office Action dated May 7, 2018 in counterpart Japan Application No. 2016-145696, together with English translation thereof.

* cited by examiner

*Primary Examiner* — Sophia S Chen
(74) *Attorney, Agent, or Firm* — Fitzpatrick, Cella, Harper & Scinto

(57) ABSTRACT

An apparatus has a detection unit, a rotating polygonal mirror and a generation unit. The rotating polygonal mirror has reflecting surfaces and configured to deflect light. The detection unit outputs a first signal in accordance with detecting the light. The generation unit, based on the first signal, generates a second signal which is a main scanning synchronization signal for controlling a write start in a main scanning direction. The second signal has a first waveform and a second waveform. The first waveform does not correspond to a reference reflection surface. The second waveform corresponds to the reference reflection surface and is different to the first waveform.

18 Claims, 9 Drawing Sheets

METHOD OF TRANSFERRING INFORMATION INDICATING REFLECTING SURFACE OF ROTATING POLYGONAL MIRROR

BACKGROUND OF THE INVENTION

Field of the Invention

The present invention relates to a method of transferring information indicating a reflecting surface of a rotating polygonal mirror.

Description of the Related Art

In an electrophotographic type image forming apparatus, a latent image is formed by a laser beam scanning a photosensitive body. A scanning apparatus of the image forming apparatus comprises a rotating polygonal mirror that deflects the laser beam. Although the rotating polygonal mirror has a plurality of reflecting surfaces, a reflection characteristic of each reflecting surface differs subtly. Thus, electronic correction of a scanning position of each reflecting surface becomes necessary. According to Japanese Patent Laid-Open No. 2006-142716, a technique for identifying each reflecting surface and for electronically correcting a scanning position by using correction data prepared for each reflecting surface is proposed.

A control unit for specifying the reflecting surface of the rotating polygonal mirror and an image processing module for electronically correcting the scanning position of each reflecting surface are independently integrated in the image forming apparatus. In such a case, a dedicated signal line for transmitting information indicating the reflecting surface that the control unit specified to the image processing module becomes necessary, leading to a cost increase for the image forming apparatus.

SUMMARY OF THE INVENTION

Accordingly, the present invention provides an image forming apparatus capable of the transmitting information indicating a reflecting surface at a low cost.

The present invention provides an image forming apparatus comprising the following elements. A light source. A rotating polygonal mirror has a plurality of reflecting surfaces and is configured to deflect light outputted from the light source while rotating. A detection unit is configured to output a first signal in accordance with detecting the light deflected by the rotating polygonal mirror. A specification unit is configured to specify a reference reflection surface out of the plurality of reflecting surfaces. A generation unit is configured to, based on the first signal, generate a second signal which is a main scanning synchronization signal for controlling a write start in a main scanning direction, wherein the second signal is a signal having a first waveform that does not correspond to the reference reflection surface and a second waveform which is a waveform that does correspond to the reference reflection surface and is different to the first waveform.

Further features of the present invention will become apparent from the following description of exemplary embodiments (with reference to the attached drawings).

DESCRIPTION OF THE EMBODIMENTS

Below, an example of a configuration for working the present invention is described in detail based on an embodiment with reference to the drawings. However, the dimensions, materials, shapes, relative positions, and the like of configuration parts described in this embodiment can be changed as appropriate according to the apparatus configuration or the conditions in which the invention is applied. Specifically, there is no intention to limit the technical scope of the present invention to the embodiment below.

Image Forming Apparatus

Figure 1:
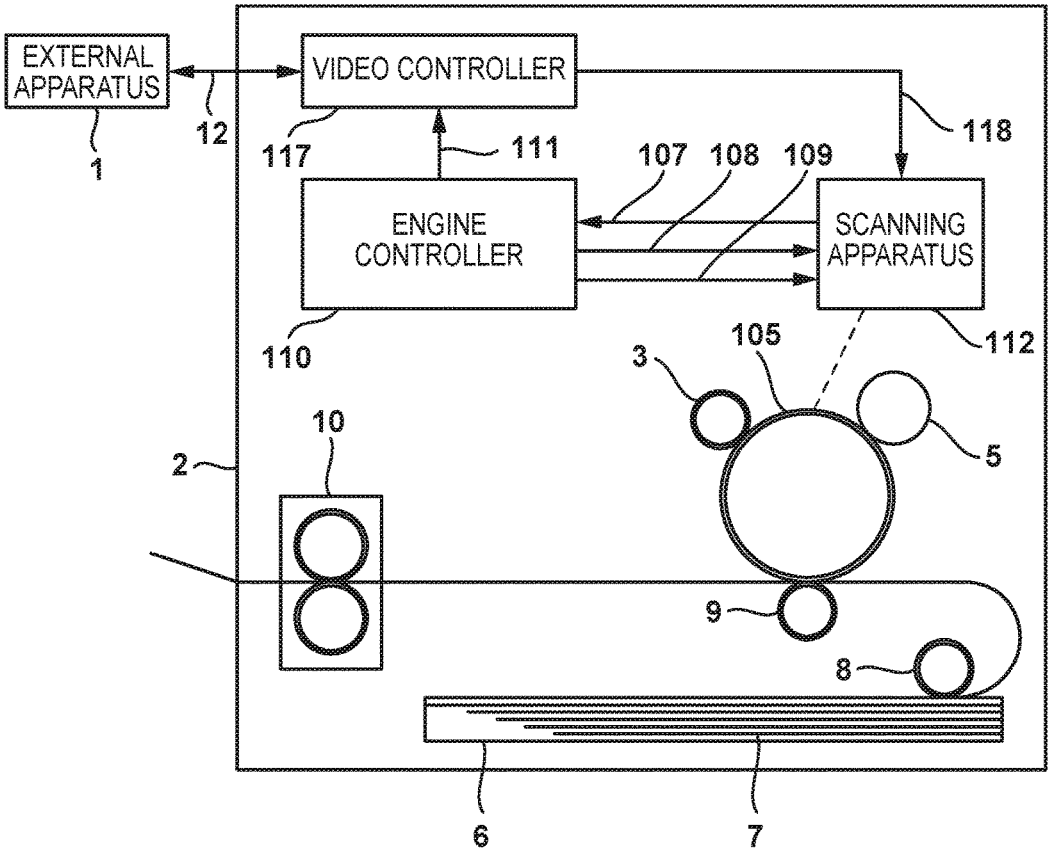
FIG. 1 is a cross-sectional view illustrating an image forming apparatus.

FIG. 1 illustrates an image forming apparatus 2. The image forming apparatus 2 receives image data from, for example, an external apparatus 1 such as a personal computer (PC), and forms an image on a sheet. The image forming apparatus 2 has an engine controller 110 functioning as a first controller and a video controller 117 functioning as a second controller. The engine controller 110 controls an image forming engine including a scanning apparatus 112 or the like. The engine controller 110 receives a BDI signal 107 from the scanning apparatus 112, and transmits a motor drive signal 108 and a laser driving signal 109 to the scanning apparatus 112. The video controller 117 is connected to the external apparatus 1 via a general-purpose interface 12, expands image data transmitted from the external apparatus 1 into bitmap data, and outputs the bitmap data as an image signal 118 to the scanning apparatus 112.

If the external apparatus 1 instructs a start of a print, the engine controller 110 starts rotation of a photosensitive body 105 which is a drum-shaped image carrier. The engine controller 110 causes the surface of the photosensitive body 105 to be charged uniformly by supplying a charge voltage to a charge roller 3. The engine controller 110 controls the scanning apparatus 112 and exposes a surface of the photosensitive body 105 with a light based on the image signal 118. By this, an electrostatic latent image is formed. The engine controller 110 controls a developing apparatus 5 to cause an electrostatic latent image to be developed by toner (developer). By this, a toner image is formed on the photosensitive body 105. The engine controller 110 drives a sheet feed roller 8 to feed a sheet 7 contained in a paper feed cassette 6 to a conveyance path. A transfer roller 9 is arranged so as to face the photosensitive body 105, conveys the sheet 7 while pinching it in cooperation with the photosensitive body 105, and transfers a toner image carried by the photosensitive body 105 onto the sheet 7. A fixing apparatus 10 fixes a toner image on the sheet 7 by applying heat and pressure.

Scanning Apparatus

Figure 2:
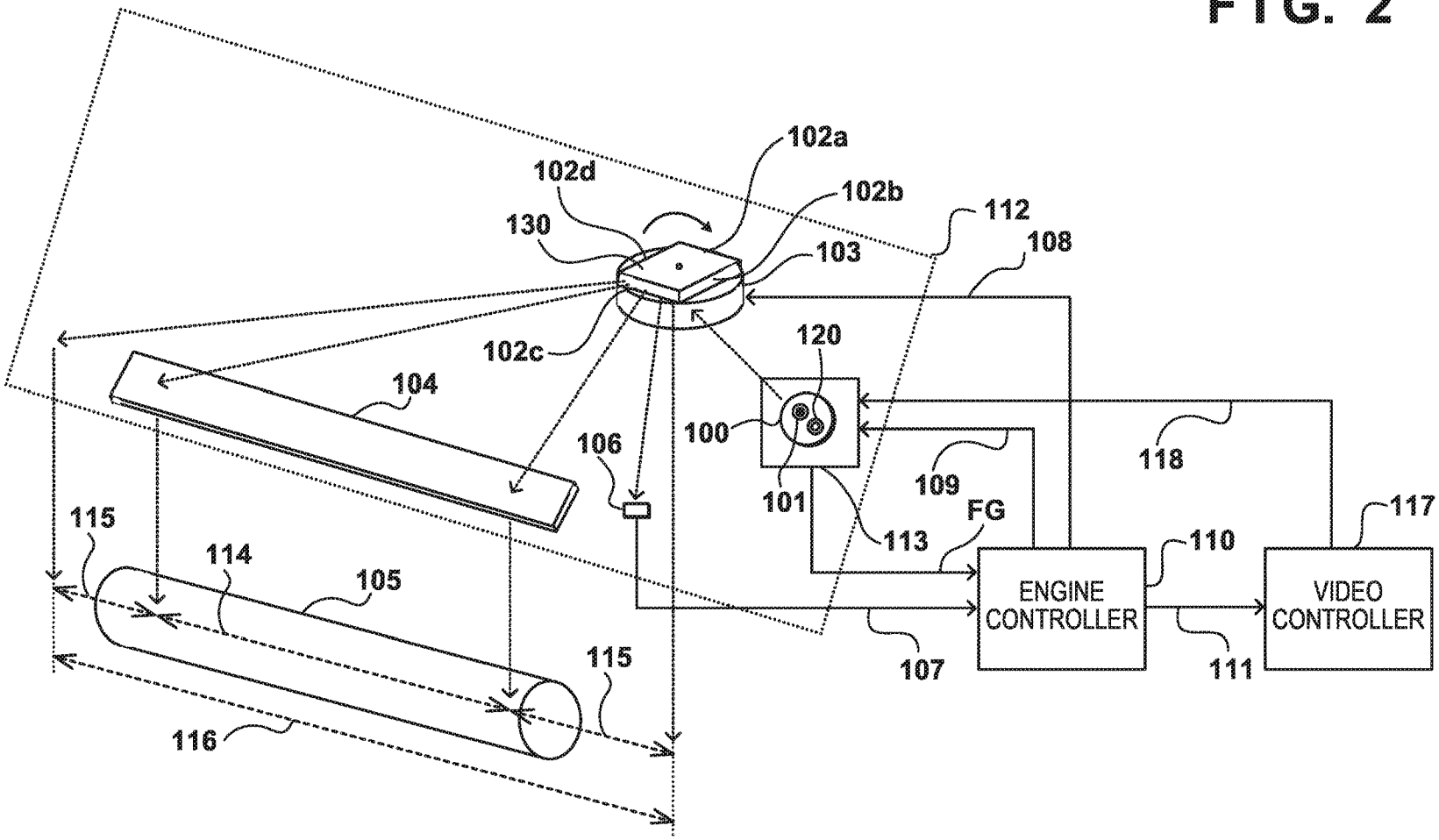
FIG. 2 is a perspective view illustrating a scanning apparatus

As shown in FIG. 2, the scanning apparatus 112 has a semiconductor laser 100 functioning as a light source for an exposure. The semiconductor laser 100 comprises a laser diode 101 and a photodiode 120. A laser drive circuit 113 lights the laser diode 101 in accordance with the laser driving signal 109 outputted from the engine controller 110. The laser drive circuit 113 detects some of the light from the laser diode 101 by the photodiode 120 and performs feedback control for the amount of light of the laser beam. The laser drive circuit 113 modulates a driving current for driving the laser diode 101 in accordance with the image signal 118 to realize image shading.

A polygonal mirror 130 is a rotating polygonal mirror having four reflecting surfaces 102*a*, 102*b*, 102*c*, and 102*d*. The polygonal mirror 130 is driven by a scanner motor 103 and rotates thereby. The scanner motor 103 rotates at a predetermined rotation speed set in accordance with the motor drive signal 108. By rotating the polygonal mirror 130, a laser beam reflected by one of reflecting surfaces scans a whole scanning region 116 at regular intervals. The whole scanning region 116 has an image region 114 and a non-image region 115. The image region 114 is a scanning region that, via a reflecting mirror 104, a laser beam, out of the laser beam reflected by the polygonal mirror 130, passes through when scanning the surface of the photosensitive body 105. The non-image region 115 is the scanning regions other than the image region 114 in the whole scanning region 116. A synchronization sensor 106 is a light receiving element arranged in a predetermined area in the non-image region 115. The synchronization sensor 106 generates a detection signal when a laser beam is detected. Hereinafter, the detection signal is represented as the BDI signal 107. BDI is an abbreviation of "Beam Detect Input". The BDI signal 107 is a signal which becomes a low level in a duration in which the laser beam is incident on the synchronization sensor 106 and becomes high-level in a duration in which the laser beam is not incident on the synchronization sensor 106. An interval (time cycle) at which a falling edge of the BDI signal 107 occurs is called a BD interval. The BDI signal 107 is inputted to the engine controller 110 as a signal which indicates an image write start timing in the main scanning direction. The engine controller 110 has a function of measuring and recording the BD interval every time the falling edge of the BDI signal 107 is detected. The engine controller 110 controls the scanner motor 103 and the semiconductor laser 100 based on the current recorded BD interval. The BD interval is inversely proportional to the rotation speed of the scanner motor 103. Thus, the engine controller 110 outputs a motor drive signal 108 which instructs an acceleration if the rotation speed is lower than a target speed. The engine controller 110 outputs a motor drive signal 108 which instructs a deceleration if the rotation speed is higher than a target speed. The engine controller 110 transmits a main scanning synchronization signal generated based on the BDI signal 107 to the video controller 117. The video controller 117 outputs the image signal 118 according to the main scanning synchronization signal. In other words, the video controller 117 is a second controller that outputs an image signal triggered by a scanning synchronization signal. Hereinafter, the main scanning synchronization signal is referred to as a BDO signal 111. BDO is an abbreviation of "Beam Detect Output". The BDO signal 111 is a signal generated by using the falling edge of the BDI signal 107 as a reference.

Relationship Between the BDI Signal and the BDO Signal

Figure 3:
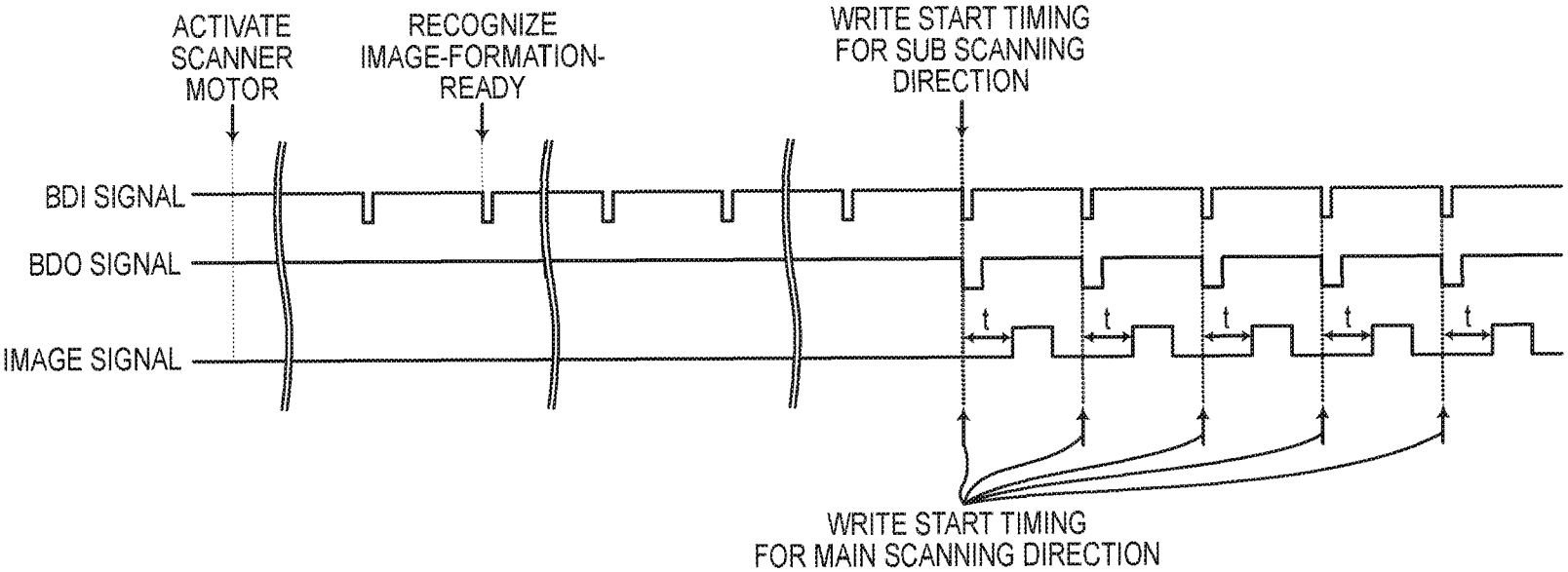
FIG. 3 is a timing chart illustrating a BDI signal, a BDO signal, and an image signal.

FIG. 3 indicates a relationship between the BDI signal 107 and the BDO signal 111. A start of a print is instructed by the external apparatus 1 and the engine controller 110 activates the scanner motor 103. The BDI signal 107 falls when the laser beam is inputted into the synchronization sensor 106. The engine controller 110 maintains the level of the BDO signal 111 at a high-level by masking the BDO signal 111 in an initial state. The video controller 117 recognizes that a request for transmission of the image signal 118 is not received because the BDO signal 111 is at the high-level. The engine controller 110 recognizes image-formation-ready when the rotation speed of the scanner motor 103 converges with the target speed. Image-formation-ready means that preparation for image formation has completed. Output of a pulse-form waveform to the video controller 117 as the BDO signal 111 is started when the engine controller 110 recognizes a write start timing for the sub scanning direction. The write start timing of the sub scanning direction is a timing at which the sheet 7 reaches a predetermined position of the conveyance path, for example. The BDO signal 111 is a pulse signal which transitions to a low-level in synchronization with the falling edge timing of the BDI signal 107 as FIG. 3 illustrates. The video controller 117 recognizes the write start timing for the sub scanning direction upon receiving an initial BDO signal 111. Additionally, the video controller 117 starts transmission of the image signal 118 to the scanning apparatus 112 when a predetermined time t elapses from the falling edge timing of the BDO signal 111. The falling edge timing of the initial and the following second BDO signal 111 is used as the write start timing of the main scanning direction.

Reason for Necessity of Correction of the Image Signal for Each Reflecting Surface There are cases in which some of the reflecting surfaces 102*a*, 102*b*, 102*c*, and 102*d* of the polygonal mirror 130 have a portion which is not parallel to the rotation shaft of the polygonal mirror 130 (a so-called plane tilt). Plane tilt occurs depending on the precision of cutting at manufacture time and the precision of assembly when assembling the scanning apparatus 112. The scanning position shifts from the target position in the sub scanning direction of the laser beam when the reflecting surface having this plane tilt deflects the laser beam. Also, there are cases in which there is a different curvature in each reflecting surface because it is difficult to process the reflecting surfaces 102*a*, 102*b*, 102*c*, and 102*d* to be completely flat surfaces by cutting processing. A phenomenon in which the scanning position of the laser beam shifts from the target position in the main scanning direction occurs when a curved reflecting surface deflects the laser beam (a so-called jitter). Thus, it is necessary to electronically correct the scanning position for each reflecting surfaces 102*a*, 102*b*, 102*c*, and 102*d*. Accordingly, the engine controller 110 specifies (identifies) which reflecting surface among the reflecting surfaces 102*a*, 102*b*, 102*c*, and 102*d* is reflecting the light, and transmits surface information indicating the reflecting surface that is specified to the video controller 117. The video controller 117 reads correction data based on the surface information to correct the image signal. In other words, correction data is read for each reflecting surface. In particular, in the present embodiment, a main scanning synchronization signal in which the surface information is superimposed is generated in order to omit a dedicated signal line for transmitting the surface information.

Internal Configuration of the Engine Controller

Figure 4:
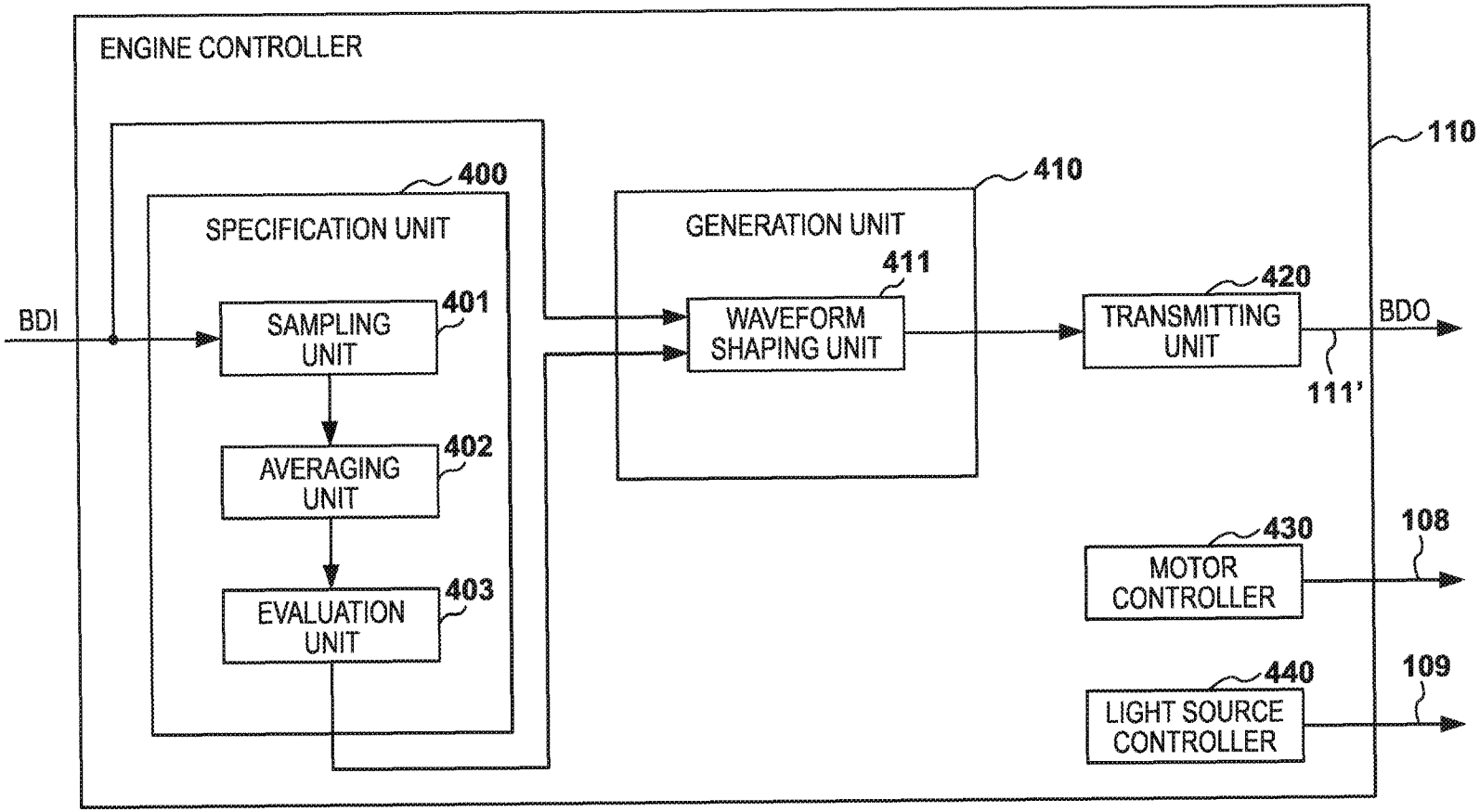
FIG. 4 is a block diagram illustrating a function of an engine controller.

In FIG. 4, a specification unit 400 specifies the reflecting surface that is reflecting the light among the plurality of reflecting surfaces based on the interval of the BDI signal 107. A sampling unit 401 samples the interval of the BDI signal 107 (BD interval) by measuring a time from the falling timing of a leading BDI signal 107 to the falling timing of a next BDI signal 107. An averaging unit 402 calculates an average value of the interval of each reflecting surface. An evaluation unit 403 identifies each reflecting surface by comparing the average values of the intervals of each reflecting surface. For example, the evaluation unit 403 specifies a reflecting surface having a largest or a smallest average value as a reference surface. If the reference surface is specified, the remaining reflecting surfaces are also specified. If the reflecting surface 102*a* is the reference surface, the reflecting surface next to the reflecting surface 102*a* is specified as the reflecting surface 102*b*. Also, the reflecting surface next to the reflecting surface 102*b* is specified as the reflecting surface 102*c*. Also, the reflecting surface next to the reflecting surface 102*c* is specified as the reflecting surface 102*d*. In this way, a specification of the remaining reflecting surfaces may be executed by the video controller 117 because the remaining reflecting surfaces can be specified if the reference surface is specified. Thus, a reference surface is specified based on the waveforms of the pulse signals generated for each reflecting surface, and the other reflecting surfaces are also specified based on the reference surface. The pulse signal waveform corresponding to the reference surface corresponds to a first waveform. The pulse signal waveform corresponding to a reflecting surface other than the reference surface corresponds to a second waveform. The reference surface is specified because the first waveform and the second waveform are different.

A generation unit 410 generates a superimposition signal by superimposing information indicating a reflecting surface (a fourth signal) onto the BDI signal 107 (the BDO signal 111). In other words, information indicating the reflecting surface that is reflecting the light is superimposed onto the BDO signal 111 and transmitted to the video controller 117 in the present embodiment. Information indicating the reflecting surface that is reflecting the light may be called surface information or phase information. The four reflecting surfaces 102*a*, 102*b*, 102*c*, and 102*d* are identified by 2-bit surface information or phase information. Note, only information indicating the reference surface (the reference reflection surface) is transmitted to the video controller 117 in a case when the specification of the other reflecting surfaces is executed by the video controller 117. The generation unit 410 is configured such that it generates an original BDO signal 111 (a third signal) based on the BDI signal 107 (a first signal) and generates a superimposition signal (a second signal) by superimposing information (a fourth signal) indicating the reflecting surface that is reflecting the light onto the BDO signal 111. Note, this corresponds to generating the original BDO signal 111 which indicates the timing at which light is detected based on the BDI signal 107 and generating a BDO signal 111' by modifying the original BDO signal 111 in accordance with the reference reflection surface. A waveform shaping unit 411 superimposes, onto the BDO signal 111, information indicating the reflecting surface that is reflecting the light by shaping the waveform of the BDO signal 111. Note, the BDO signal 111 onto which the surface information has not been superimposed may be referred to as the original BDO signal 111 and the BDO signal 111 onto which the surface information is superimposed may be referred to as the superimposition signal or the BDO signal 111'. A transmitting unit 420 is a communication port or a circuit for transmitting the BDO signal 111' to the video controller 117. A motor controller 430 controls the scanner motor 103. A light source control unit 440 controls the semiconductor laser 100.

Internal Configuration of the Video Controller

Figure 5:
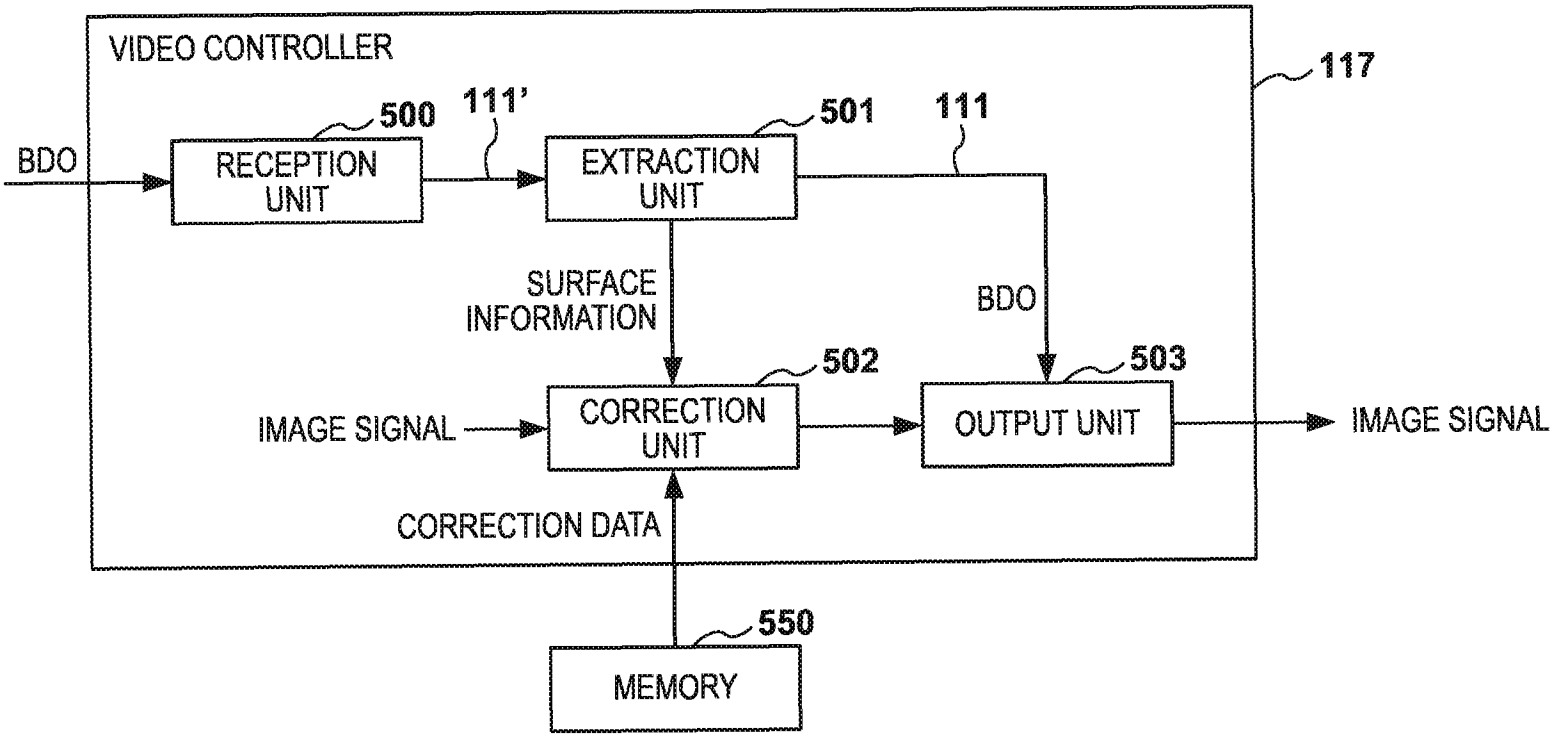
FIG. 5 is a block diagram illustrating a function of a video controller.

In FIG. 5, a reception unit 500 is a communication port or a circuit for receiving the BDO signal 111'. An extraction unit 501 extracts the original BDO signal 111 and the surface information from the BDO signal 111'. A correction unit 502 reads the correction data corresponding to each of the plurality of the reflecting surfaces in order based on the surface information extracted by the extraction unit 501, and corrects the image signal. Note, the correction data corresponding to each of the plurality of the reflecting surfaces is stored on a non-volatile memory 550 mounted to the scanning apparatus 112. An output unit 503 outputs, to the laser drive circuit 113, the image signal corrected by the correction unit 502 using the falling timing of the BDO signal 111 as a reference. The laser drive circuit 113 drives the semiconductor laser 100 based on the corrected image signal.

Flowchart

Figure 6:
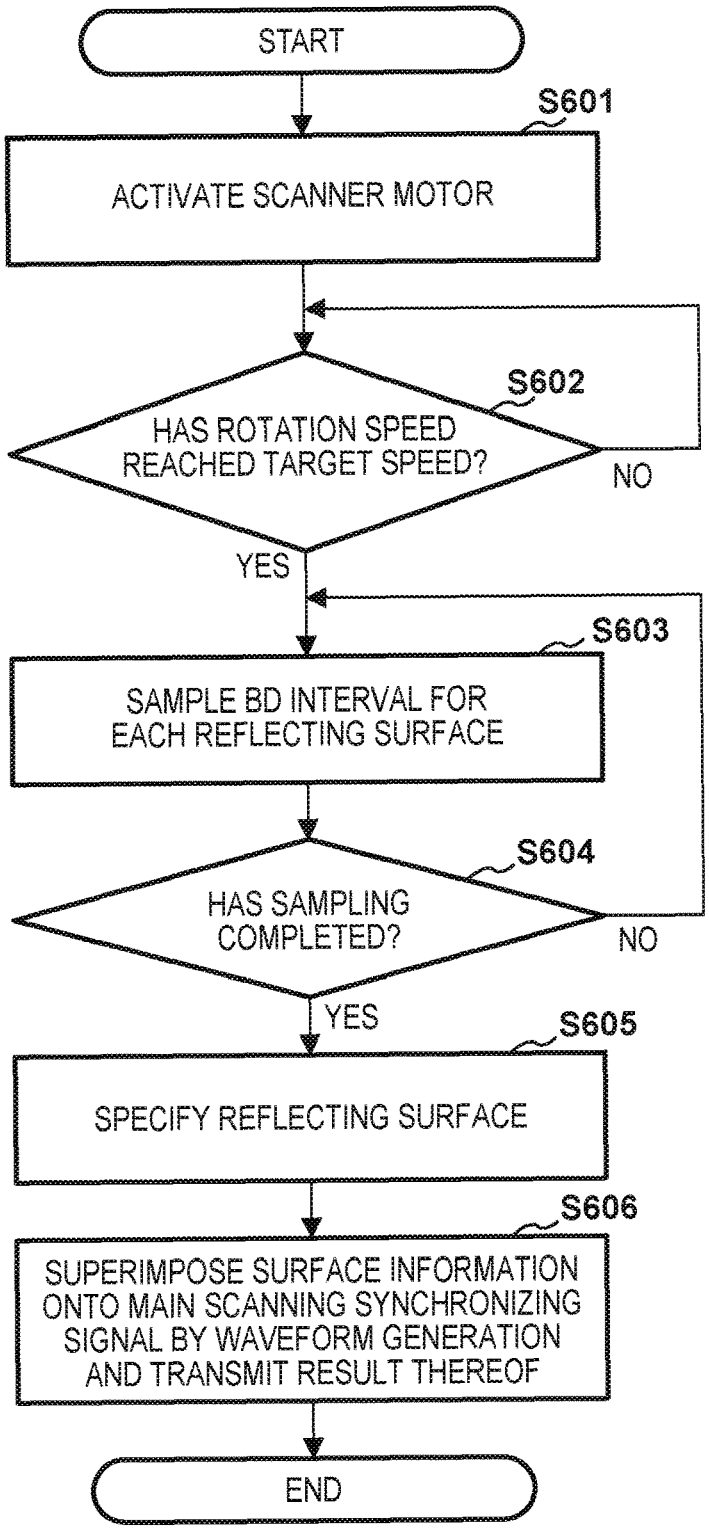
FIG. 6 is a flowchart illustrating a process for specifying a reflecting surface.

FIG. 6 illustrates processing for specifying the reflecting surface which the engine controller 110 executes. This specifying processing is executed when a start of a print is instructed from the external apparatus 1. In step S601, the engine controller 110 (motor controller 430) generates and outputs the motor drive signal 108 to activate the scanner motor 103. In step S602, the engine controller 110 determines whether or not the rotation speed of the scanner motor 103 reached the target speed. As described above, the sampling unit 401 measures the BD interval, and the BD interval is inversely proportional to the rotation speed. Accordingly, the engine controller 110 can calculate the rotation speed from the BD interval. Note, in a case when the scanner motor 103 outputs a signal indicating the rotation speed such as an FG signal, the engine controller 110 may obtain the rotation speed using that signal. When the rotation speed reaches the target speed, the engine controller 110 advances to step S603.

In step S603, the engine controller 110 (the sampling unit 401) samples the BD interval for each reflecting surface. In step S604, the engine controller 110 (the sampling unit 401) determines whether or not the sampling of the BD interval completed. For example, if N sampling values are obtained for each reflecting surface, the engine controller 110 determines that the sampling of the BD interval has completed. When the sampling of the BD interval completes, the engine controller 110 advances to step S605.

In step S605, the engine controller 110 (the specification unit 400) specifies the reflecting surface. First, the averaging unit 402 calculates a BD interval average value for each reflecting surface. At this stage, the reflecting surfaces have not yet been identified, and so the BD intervals first inputted are managed as BD interval P1i of the first reflecting surface. The BD intervals inputted second are managed as BD interval P2i of the second reflecting surface. The BD intervals inputted third are managed as BD interval P3i of the third reflecting surface. The BD intervals inputted fourth are managed as BD interval P4i of the fourth reflecting surface. i is a variable that is incremented each time the polygonal mirror 130 rotates once. In other words, when the polygonal mirror 130 rotates N times, BD intervals P11-P1N of the first reflecting surface are obtained. Accordingly, the average value P1 of the BD intervals of the first reflecting surface is (ΣP1i)/N. Various algorithms can be considered for specifying the reflecting surfaces. For example, the reflecting surface having the largest BD interval out of the four reflecting surfaces may be specified as the reference surface. Alternatively, the reflecting surface having the smallest BD interval out of the four reflecting surfaces may be specified as the reference surface. The jth reflecting surface may be specified as the reference surface when the difference between the BD interval of the jth reflecting surface and the BD interval of the j+1th reflecting surface which are adjacent is the largest or the smallest. In this way, the reflecting surface specification is executed based upon the particular nature of the BD interval of the reference surface out of the reflecting surfaces 102*a*, 102*b*, 102*c*, and 102*d*. The evaluation unit 403 compares the average values P1-P4 of the BD intervals of the reflecting surfaces and specifies the reflecting surface having the largest average value Px as the reference surface. In other words, when the reference surface is scanning the light, the evaluation unit 403 outputs to the waveform shaping unit 411 surface information indicating that the reference surface is scanning the light. For example, the surface information that indicates that the reference surface is scanning the light may be "00". Surface information indicating that the reflecting surface next to the reference surface is scanning the light is "01". Surface information indicating that a reflecting surface two over from the reference surface is scanning the light is "10". Surface information indicating that a reflecting surface three over from the reference surface is scanning the light is "11".

In step S606, the engine controller 110 (the generation unit 410) superimposes surface information onto the main scanning synchronization signal by waveform shaping and transmits it via the transmitting unit 420. As described above, the BDO signal 111' is transmitted.

Surface Information Superimposition Processing by Waveform Shaping

The waveform shaping unit 411 of the generation unit 410 differentiates the waveform of the BDO signal 111 when the reference surface is deflecting the laser beam from the waveform of the BDO signal 111 when the reflecting surfaces other than the reference surface are deflecting the laser beam. The surface information is superimposed onto the BDO signal 111 accordingly.

(1) Pulse Width

The waveform shaping unit 411 may notify the reference surface to the video controller 117 by differentiating the pulse width of the BDO signal 111 when the reference surface is reflecting the laser beam from the pulse widths of the BDO signal 111 when the other reflecting surfaces are reflecting the laser beam.

Figure 7:
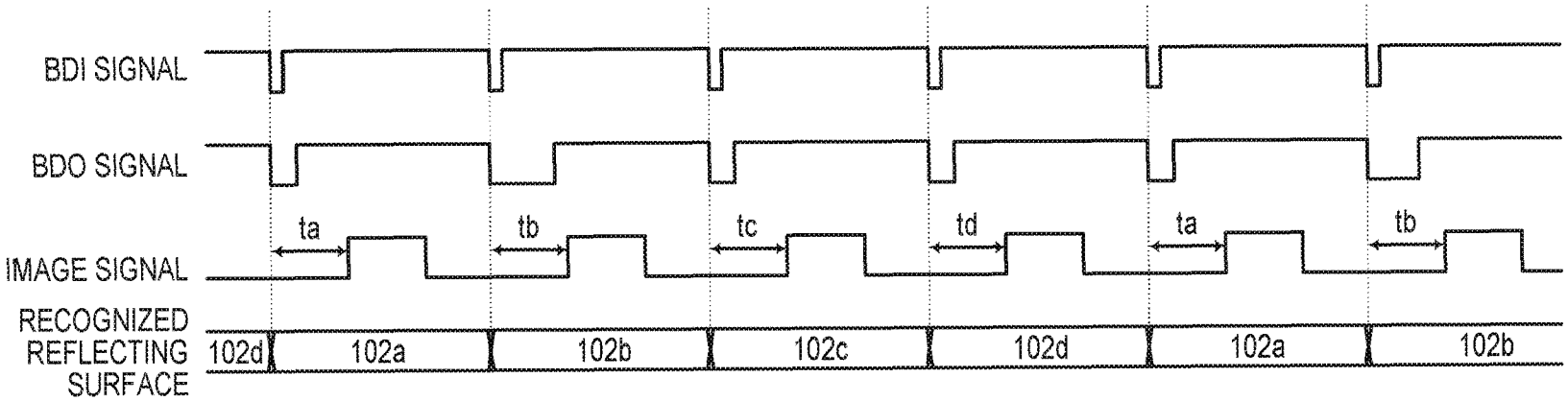
FIG. 7 is a timing chart illustrating a BDI signal, a BDO signal, and an image signal.

FIG. 7 illustrates an example of waveform shaping. In this example, the specification unit 400 specifies the reflecting surface 102*b* as the reference surface. The waveform shaping unit 411 makes the pulse width of the BDO signal 111 when the reflecting surface 102*b* is scanning the laser beam longer than the pulse width of the BDO signal 111 when the other reflecting surfaces are scanning the laser beam. The pulse widths of the other three reflecting surfaces may be the same or they may each be different. Here, the pulse width indicates the time from the trailing edge to the rising edge. Note that while the pulse width is adjusted, the falling timing of the BDO signal 111 is not changed. This is because the falling timing of the BDO signal 111 is used for transferring the write start timing.

The extraction unit 501 of the video controller 117 measures the pulse width of the BDO signal 111' with a counter or the like, and determines whether or not the measured pulse width is the reference surface pulse width. If the measured pulse width is the reference surface pulse width, the extraction unit 501 outputs surface information indicating the reference surface to the correction unit 502. When the extraction unit 501 discovers the reference surface, it increments the surface information in order and outputs the surface information to the correction unit 502 whenever it detects a trailing edge of the BDO signal 111'. Note that when 11 is outputted as the surface information, the surface information is reset to 00. The correction unit 502 may convert the surface information into address information of the memory 550, and may read correction data from the memory 550 in accordance with the address information. The correction data in FIG. 7 is data for correcting the write start timing for the main scanning direction, and indicates an elapsed time ta-td from the falling timing of the BDO signal 111.

As described above, the memory 550 of the scanning apparatus 112 holds correction data decided based on property information differing for each scanning apparatus 112 at the time of shipment from a factory in advance. The memory 550 stores data for correcting plane tilt, jitter, or the like mainly measured at the time of shipment from a factory (information indicating an irradiation position) and simplified information related to the specification unit 400 in association. More specifically, at the time of shipping inspection, the inspection apparatus measures irradiation positions for each of the reflecting surfaces 102*a*, 102*b*, 102*c*, and 102*d* and measures the BD interval. The inspection apparatus specifies the reflecting surface that is the reference surface from the measured BD interval, and adds surface information to each reflecting surface in order from the reference surface according to the rotation direction. The inspection apparatus stores irradiation position information of each reflecting surface in the memory 550 in association with the surface information. Configuration may be taken such that a two-dimensional barcode or the like indicating the surface information and the correction data is affixed to an external surface of the housing of the scanning apparatus 112 if the scanning apparatus 112 does not comprise the memory 550. When the scanning apparatus 112 is embedded in the image forming apparatus 2, configuration may be taken such that an operator reads the two-dimensional barcode using a barcode reader and stores the reading result in a non-volatile memory (not shown) in the image forming apparatus 2.

The correction unit 502 of the video controller 117 reads the correction data for each of the reflecting surfaces 102*a*, 102*b*, 102*c*, and 102*d* and corrects the irradiation position. By this, the influence of plane tilt and jitter is reduced.

The video controller 117 may execute magnification correction for each of the reflecting surfaces 102*a*, 102*b*, 102*c*, and 102*d*. Magnification correction is information indicating a scaling factor of the length of the image in the main scanning direction. In such a case, information of the frequency of image clock used for generating the image signal 118 is included as the correction data.

According to the embodiment, the surface information indicating the reflecting surface that is reflecting the laser beam is superimposed onto the BDO signal 111 and transmitted. Thereby, a dedicated signal line for transmitting the surface information becomes unnecessary, and manufacturing cost for the image forming apparatus 2 is reduced. Note that the waveform shaping unit 411 superimposes surface information on the BDO signal 111 such that the falling timing of the BDO signal 111 is maintained. Thus, the original function that the BDO signal 111 has (an image write start timing transmission function) is not lost.

In the example illustrated in FIG. 7, the pulse width corresponding to the reference surface is lengthened, but configuration may also be taken such that the BDO signal 111 is shaped so as to shorten the pulse width corresponding to the reference surface. It is sufficient that the video controller 117 is able to recognize the reference surface by detecting the pulse width of the BDO signal 111 in this way.

(2) Number of Pulses

Figure 8A:
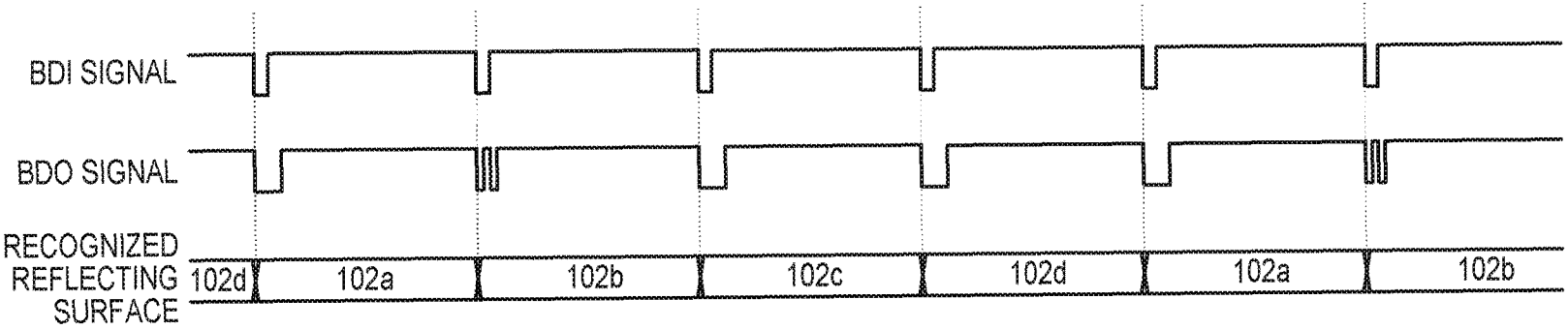
FIGS. 8A and 8B are timing charts illustrating a BDI signal, a BDO signal, and an image signal.
Figure 8B:
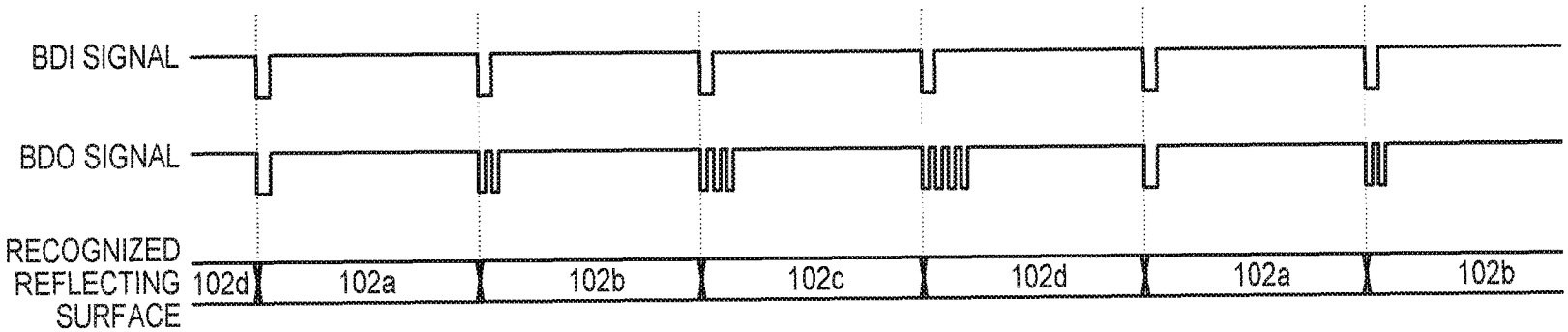

FIG. 8A and FIG. 8B illustrate methods for superimposing surface information by differentiating the number of pulses. According to FIG. 8A, the waveform shaping unit 411 shapes the BDO signal 111 so that the number of pulses is two for the reflecting surface 102*b* which is the reference surface. The number of pulses for the other reflecting surfaces remains at one. Thus, the extraction unit 501 of the video controller 117 recognizes the reference surface by detecting the number of pulses of the BDO signal 111.

According to FIG. 8B, the number of pulses is differentiated for all of the reflecting surfaces including the reference surface. The number of pulses for the reflecting surface 102*a* is one. The number of pulses for the reflecting surface 102*b* is two. The number of pulses for the reflecting surface 102*c* is three. The number of pulses for the reflecting surface 102*d* is four. In this way, the waveform shaping unit 411 shapes the BDO signal 111 so that the number of pulses differs for each reflecting surface. Thus, the extraction unit 501 of the video controller 117 can recognize all of the reflecting surfaces by detecting the number of pulses of the BDO signal 111.

In this way, by representing the surface information by the number of pulses, a dedicated signal line for transmitting surface information becomes unnecessary, and the manufacturing cost for the image forming apparatus 2 is reduced. Also, the degree of freedom regarding waveform shaping of the BDO signal 111 is increased. Note that while the number of pulses is adjusted, the falling timing of the BDO signal 111 is not changed. In other words, the falling timing of the first pulse is synchronized with the falling timing of the BDO signal 111, and is used to transfer the write start timing.

(3) BDO Signal Thinning

Figure 9A:
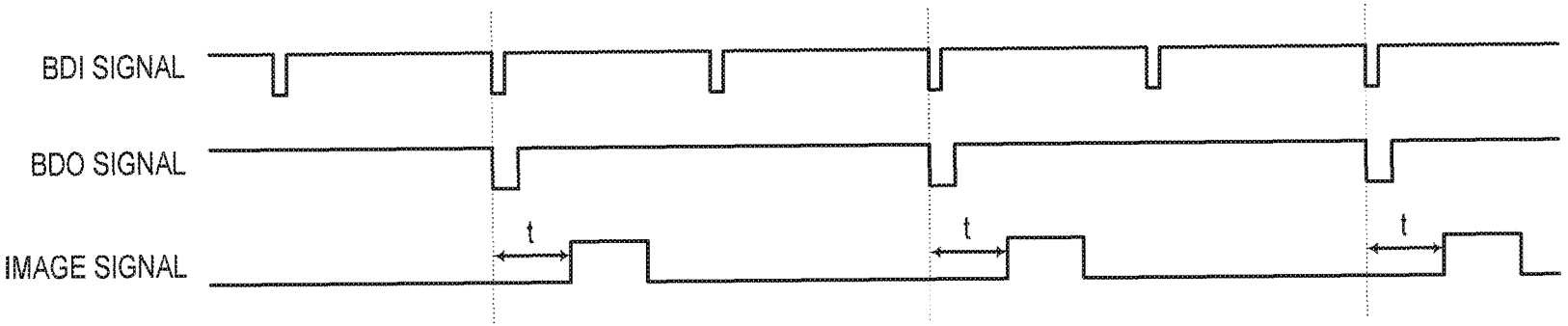
FIGS. 9A and 9B are timing charts illustrating a BDI signal, a BDO signal, and an image signal.

The image forming apparatus 2 may have a plurality of image forming speeds. For example, there are cases in which a first image forming speed is used in a job for forming an image on normal paper and a second image forming speed is used in a job for forming an image on thick paper. Here, the second image forming speed is half of the first image forming speed. In such a case, while the scanning speed is not changed in the main scanning direction, the scanning speed in the sub scanning direction is changed to be half. This can be realized by using every other surface of the four reflecting surfaces while maintaining the rotation speed of the polygonal mirror 130. For example, the reflecting surfaces 102*a* and 102*c* are used to reflect the laser beam and the reflecting surfaces 102*b* and 102*d* are not used to reflect the laser beam. As illustrated in FIG. 9A, the engine controller 110 thins out the leading BDO signal 111 out of two BDO signals 111. Because the video controller 117 reduces the frequency at which the trailing edge of the BDO signal 111 is detected to half, the transmission frequency of the image signal 118 is also halved. Thus, even if the image forming speed is changed to half speed, the scaling factor of the image of the sub scanning direction is maintained. In a case in which such thinning of BDO signals is applied, a design for a method of representing surface information becomes necessary.

Figure 9B:
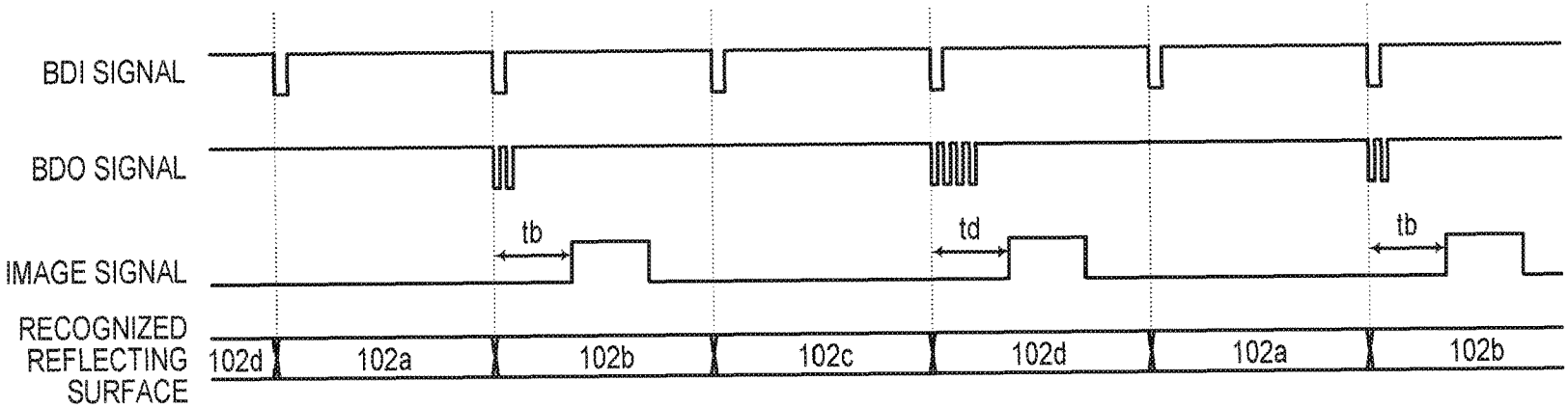

As illustrated by FIG. 9B, in the case in which the generation unit 410 executes thinning of the BDO signal 111, a method of differentiating the number of pulses of the BDO signal 111 for all of the reflecting surfaces is effective. The waveform shaping unit 411 shapes the BDO signal 111 so that the number of pulses corresponding to the reflecting surface 102*a* becomes one. The waveform shaping unit 411 shapes the BDO signal 111 so that the number of pulses corresponding to the reflecting surface 102*b* becomes two. The BDO signal 111 is shaped so that the number of pulses corresponding to the reflecting surface 102*c* becomes three. The BDO signal 111 is shaped so that the number of pulses corresponding to the reflecting surface 102*d* becomes four. When the thick paper mode is enabled from an operating unit or the like, the waveform shaping unit 411 executes thinning of the BDO signal 111. For example, the waveform shaping unit 411 realizes thinning by masking the BDO signal corresponding to the reflecting surface 102*a* and the BDO signal corresponding to the reflecting surface 102*c*. Of course, it is also possible to thin out the BDO signal corresponding to the reflecting surface 102*b* and the BDO signal corresponding to the reflecting surface 102*d*.

The extraction unit 501 of the video controller 117 restores the surface information by counting the number of pulses. The correction unit 502 reads from the memory 550*tb* which is correction data for the reflecting surface 102*b* if the number of pulses is two, and corrects the output timing of the image signal 118. The correction unit 502 reads from the memory 550*td* which is correction data for the reflecting surface 102*d* if the number of pulses is four, and corrects the output timing of the image signal 118.

When a waveform shaping method is employed in this way such that it is possible to identify each reflecting surface, even if thinning of the BDO signal is applied, the extraction unit 501 can correctly extract the surface information. While the number of pulses are differentiated here, the waveform shaping unit 411 may differentiate the pulse widths for each reflecting surface.

CONCLUSION

The specification unit 400 specifies the reflecting surface on which light is reflected among the plurality of reflecting surfaces based on the interval of the BDI signal 107 that the synchronization sensor 106 outputs. The generation unit 410 generates the BDO signal 111' by superimposing surface information indicating the reflecting surfaces onto the BDI signal 107 (the BDO signal 111). The reception unit 500 receives the BDO signal 111' transmitted by the transmitting unit 420. The extraction unit 501 extracts the surface information superimposed onto the BDO signal 111'. The correction unit 502 reads the correction data corresponding to each of the plurality of the reflecting surfaces in order based on the surface information extracted by the extraction unit 501, and corrects the image signal 118. The laser drive circuit 113 drives the semiconductor laser 100 based on the image signal 118 corrected by the correction unit 502. Because the surface information is superimposed onto the main scanning synchronization signal and transmitted in this way, a dedicated signal line for transmitting the surface information becomes unnecessary. Thus, the cost of the image forming apparatus 2 is reduced.

The generation unit 410 may generate the BDO signal 111 based on the BDI signal 107, and generate the BDO signal 111' by superimposing the surface information onto the BDO signal 111. The correction unit 502 may start output of the image signal 118 for each main scanning line based on the main scanning synchronization signal (the falling edge of the BDO signal 111') which is included in the BDO signal 111'. The generation unit 410 may have the waveform shaping unit 411 which superimposes the surface information onto the BDO signal 111 by shaping the waveform of the BDO signal 111. As FIG. 7 illustrates, the waveform shaping unit 411 may generate a pulse signal which is a main scanning synchronization signal based on the detection signal, and shape the pulse signal such that the time from the trailing edge to the rising edge of the pulse signal indicates the surface information. Note that, it is sufficient that the waveform shaping unit 411 shapes the pulse signal such that it is possible to at least distinguish by the extraction unit 501 the reference reflection surface which is to be a reference among the plurality of reflecting surfaces and the reflecting surfaces other than the reference reflection surface among the plurality of reflecting surfaces. As FIG. 7 illustrates, the waveform shaping unit 411 may differentiate a first time from the trailing edge to the rising edge of the pulse signal indicating the reference reflection surface and a second time from the trailing edge to the rising edge of the pulse signal indicating the other reflecting surfaces. The waveform shaping unit 411 may shape the pulse signal to be able to identify each of the plurality of reflecting surfaces. For example, pulse widths may be different for each reflecting surface. In other words, the waveform shaping unit 411 may differentiate the times from the trailing edge to the rising edge of the pulse signals for each reflecting surface.

As illustrated in FIG. 8B, the waveform shaping unit 411 may generate the pulse signals such that the differences in the number of pulse signals indicates the reflecting surface that is reflecting the light. Note that, it is sufficient that the waveform shaping unit 411 executes waveform shaping such that it is possible to at least distinguish by the extraction unit 501 the reference reflection surface which is to be the reference among the plurality of reflecting surfaces and the reflecting surfaces other than the reference reflection surface among the plurality of reflecting surfaces. For example, the waveform shaping unit 411 may differentiate the number of pulse signals related to the reference reflection surface and the number of pulse signals related to the other reflecting surfaces. It is sufficient if at least the reference reflection surface is identified in this way. However, the waveform shaping unit 411 may differentiate the number of pulse signals for each reflecting surface so that each of the plurality of reflecting surfaces is distinguished. In other words, the number of pulses may indicate the reflecting surface.

When a thick paper mode is designated, the image forming speed of the image forming apparatus 2 is changed from a first speed to a lower second speed. As FIG. 9A illustrates, the generation unit 410 outputs the BDO signal 111' of a number less than the number of the BDI signal 107 by thinning out the BDO signal 111 in accordance with the second speed. Specifically, even if the BDO signal 111 is thinned, by the number of pulse signals being differentiated so that it is possible to identify each reflecting surface, and the pulse widths being differentiated, it is possible to distinguish the reflecting surfaces.

As FIG. 4 illustrates, the specification unit 400, the generation unit 410, and the transmitting unit 420 may be mounted in the engine controller 110 which is a first controller. The reception unit 500, the extraction unit 501, and the correction unit 502 may be mounted in the video controller 117 which is a second controller. In such a case, the transmitting unit 420 and the reception unit 500 are connected by a signal line. In particular, in such a case, it becomes possible to reduce the number of signal lines between the plurality of controllers.

Note that the semiconductor laser 100, the polygonal mirror 130, and the synchronization sensor 106 are mounted in the scanning apparatus 112. The memory 550 may be mounted in the scanning apparatus 112. Because the correction data is correction data specific to the polygonal mirror 130 mounted in the scanning apparatus 112, it is stored in the memory 550 mounted in the scanning apparatus 112. In place of the memory 550, an information holding unit such as a two-dimensional barcode may be employed.

In the embodiment described above, surface information indicating the reference surface is superimposed onto the BDO signal 111 generated based on the BDI signal 107 based on light reflected by the reflecting surface 102*a* which is the reference surface, for example. This is advantageous in that it is possible to transmit the surface information in real time. If a stringent real-time nature is not required, the surface information may be superimposed on the BDO signal 111 based on another reflecting surface. For example, surface information indicating that the reflecting surface 102*a* is the reference surface may be superimposed onto the BDO signal 111 for one of the reflecting surfaces 102*b*, 102*c*, and 102*d* which reflect the light after the reflecting surface 102*a*. For example, assume that it is defined that the surface information is superimposed onto the BDO signal 111 corresponding to the reflecting surface 102*b* after the reflecting surface 102*a* which is the reference surface. In such a case, the video controller 117 is able to determine that one reflecting surface prior to the reflecting surface specified from the BDO signal 111 is the reflecting surface 102*a* which is the reference surface. Also, the surface information of the polygonal mirror 130 obtained one rotation prior may be superimposed onto one of the BDO signals 111 of the polygonal mirror 130 two rotations prior.

In the above described embodiment, the surface information is used to correct the image signal, but the surface information may be used for other control in the image forming apparatus.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-145696, filed Jul. 25, 2016, which is hereby incorporated by reference herein in its entirety.

What is claimed is:

1. An image forming apparatus comprising:

a light source;

a rotating polygonal mirror having a plurality of reflecting surfaces and configured to deflect light outputted from the light source while rotating;

a detection unit configured to output a first signal in accordance with detecting the light deflected by the rotating polygonal mirror;

a specification unit configured to specify a reference reflection surface out of the plurality of reflecting surfaces; and a generation unit configured to, based on the first signal, generate a second signal which is a main scanning synchronization signal for controlling a write start in a main scanning direction, wherein the second signal is a signal having a first waveform that does not correspond to the reference reflection surface and a second waveform which is a waveform that does correspond to the reference reflection surface and is different to the first waveform, wherein the generation unit changes, in accordance with the reference reflection surface, a duration from a trailing edge to a rising edge or a rising edge to a trailing edge of a pulse signal which is the second signal, or the generation unit changes, in accordance with the reference reflection surface, a number of pulses of a pulse signal which is the second signal.

2. The image forming apparatus according to claim 1, wherein a timing of a change in a waveform in the first signal that indicates that light is detected is maintained in the second signal.

3. The image forming apparatus according to claim 1, further comprising:

a transmission unit configured to transmit the second signal;

a reception unit configured to receive the second signal transmitted by the transmission unit; and an extraction unit configured to extract information indicating the reference reflection surface from the second signal.

4. The image forming apparatus according to claim 3, further comprising:

a storage unit configured to store correction data corresponding to each of the plurality of reflecting surfaces;

a correction unit configured to read correction data corresponding to each of the plurality of reflecting surfaces based on the information indicating the reference reflection surface extracted by the extraction unit, and correct image data; and a driving unit configured to drive the light source based on the image data corrected by the correction unit.

5. The image forming apparatus according to claim 4, wherein the correction unit starts output of the image data of each main scanning line based on the second signal.

6. The image forming apparatus according to claim 4, wherein the storage unit is mounted on a scanning apparatus.

7. The image forming apparatus according to claim 3, further comprising:

a first controller having the specification unit, the generation unit, and the transmission unit, and a second controller having the reception unit and the extraction unit, wherein the transmission unit and the reception unit are connected by a signal line for transmitting the second signal.

8. The image forming apparatus according to claim 1, wherein the generation unit generates a third signal indicating a timing at which the light is detected based on the first signal and generates the second signal by modifying the third signal in accordance with the reference reflection surface.

9. The image forming apparatus according to claim 1, wherein the generation unit generates a third signal indicating a timing at which the light is detected based on the first signal and generates the second signal by superimposing a fourth signal indicating the reference reflection surface onto the third signal.

10. The image forming apparatus according to claim 1, wherein the specification unit specifies the reference reflection surface based on a time cycle of the first signal.

11. The image forming apparatus according to claim 1, wherein the generation unit differentiates, in order to be able to identify the reference reflection surface and the reflecting surfaces other than the reference reflection surface out of the plurality of reflecting surfaces, a first time duration from a trailing edge to a rising edge or a rising edge to a trailing edge of the pulse signal indicating the reference reflection surface and a second time duration from a trailing edge to a rising edge or a rising edge to a trailing edge of the pulse signal indicating the other reflecting surfaces.

12. The image forming apparatus according to claim 1, wherein the generation unit differentiates, in order to be able to identify each of the plurality of reflecting surfaces, a duration from a trailing edge to a rising edge or a rising edge to a trailing edge of the pulse signal for each reflecting surface.

13. The image forming apparatus according to claim 1, wherein the generation unit differentiates, in order to be able to identify the reference reflection surface and the reflecting surfaces other than the reference reflection surface out of the plurality of reflecting surfaces, the number of pulses for each reflecting surface.

14. The image forming apparatus according to claim 1, wherein the generation unit outputs, when an image forming speed of the image forming apparatus is changed from a second speed lower than a first speed, a smaller number of signals than the number of signals in the first signal by thinning out the second signal in accordance with the second speed.

15. The image forming apparatus according to claim 1, wherein the light source, the rotating polygonal mirror, and the detection unit are mounted on a scanning apparatus.

16. An image forming apparatus comprising:

a first controller configured to transmit a main scanning synchronization signal, and a second controller configured to output image data triggered by the main scanning synchronization signal, wherein the first controller specifies a reference reflection surface in a plurality of reflecting surfaces that a rotating polygonal mirror comprises, and transmits to the second controller a main scanning synchronization signal having a first waveform that does not correspond to the reference reflection surface and a second waveform which is a waveform that does correspond to the reference reflection surface and is different to the first waveform, and wherein the first controller unit changes, in accordance with the reference reflection surface, a duration from a trailing edge to a rising edge or a rising edge to a trailing edge of a pulse signal which is the second signal, or the first controller changes, in accordance with the reference reflection surface, a number of pulses of a pulse signal which is the second signal.

17. A controller that controls a scanning apparatus having a light source, a plurality of reflecting surfaces, a rotating polygonal mirror that deflects light outputted from the light source while rotating, and a detection unit that outputs a first signal in accordance with detecting the light deflected by the rotating polygonal mirror, the controller comprising:

a specification unit configured to specify a reference reflection surface out of the plurality of reflecting surfaces; and a generation unit configured to, based on the first signal, generate a second signal which is a main scanning synchronization signal for controlling a write start in a main scanning direction, wherein the second signal is a signal having a first waveform that does not correspond to the reference reflection surface and a second waveform which is a waveform that does correspond to the reference reflection surface and is different to the first waveform, and wherein the generation unit changes, in accordance with the reference reflection surface, a duration from a trailing edge to a rising edge or a rising edge to a trailing edge of a pulse signal which is the second signal, or the generation unit changes, in accordance with the reference reflection surface, a number of pulses of a pulse signal which is the second signal.

18. A controller that generates image data that becomes a basis for an image formed by a scanning apparatus having a light source, a plurality of reflecting surfaces, a rotating polygonal mirror that deflects light outputted from the light source while rotating, and a detection unit that outputs a first signal in accordance with detecting the light deflected by the rotating polygonal mirror, the controller comprising:

a reception unit configured to receive a second signal, which is a main scanning synchronization signal for controlling a write start in a main scanning direction and which is generated, based on the first signal, in another controller that controls the scanning apparatus by a reference reflection surface out of the plurality of reflecting surfaces being specified, the second signal having a first waveform that does not correspond to the reference reflection surface and a second waveform which is a waveform that does correspond to the reference reflection surface and is different to the first waveform; and an extraction unit configured to extract information indicating the reference reflection surface from the second signal.

* * * * *